United States Patent [19]

Wenthe, Jr.

[11] 4,262,895

[45] Apr. 21, 1981

[54] INVERTER WITH VARIABLE BUCKLING CONTROL

[75] Inventor: Stephen J. Wenthe, Jr., Rochester, N.Y.

[73] Assignee: Xerox Corporation, Stamford, Conn.

[21] Appl. No.: 71,604

[22] Filed: Aug. 31, 1979

[51] Int. Cl.[3] ..... B65H 29/58

[52] U.S. Cl. ..... 271/65; 271/DIG. 9; 271/184; 271/188

[58] Field of Search ..... 271/DIG. 9, 65, 184–186, 271/188, 245

[56] References Cited

U.S. PATENT DOCUMENTS

| | | | |
|---|---|---|---|
| 700,722 | 5/1902 | Appel | 271/DIG. 9 |
| 3,337,213 | 8/1967 | La Barre | 271/184 X |
| 3,672,765 | 6/1972 | Altmann | 271/DIG. 9 |
| 3,963,339 | 6/1976 | Taylor et al. | 271/245 X |

*Primary Examiner*—Robert W. Saifer

[57] ABSTRACT

A sheet inverter which accommodates the reversal of motion of sheets of different sizes within a curved fixed length inversion chute having a variable buckle control provided by highly flexible and low force spring members chordally intersecting the inverter chute which provide assistance in positively feeding the sheet back out of the chute, after it has been positively buckled therein against the chute end, but allows the undisturbed formation of buckles of various dimensions within the chute depending on the size of the sheet.

7 Claims, 2 Drawing Figures

INVERTER WITH VARIABLE BUCKLING CONTROL

Figure 1:
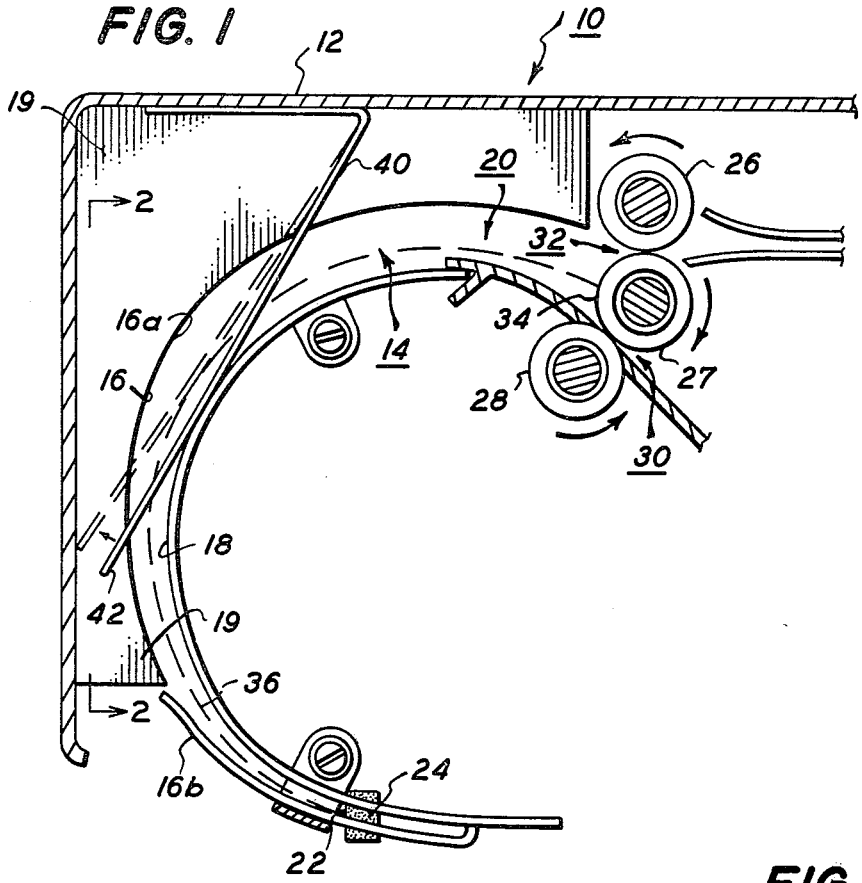

The present invention relates to an improved sheet inverting system, and more particularly to an inverter providing improved handling of variable sized sheets within an inverter having a fixed buckling end position.

As xerographic and other copiers increase in speed, and become more automatic, it is increasingly important to provide higher speed yet more reliable and more automatic handling of both the copy sheets being made by the copier and the original document sheets being copied. It is desired to accommodate sheets which may vary widely in size, weight, thickness, material, condition, humidity, age, etc.. These variations change the beam strength of flexural resistance and other characteristics of the sheets. Yet the desire for automatic and high speed handling of such sheets without jams, misfeeds, uneven feeding times, or other interruptions increases the need for reliability of all sheet handling components. A sheet inverter is one such sheet handling component with particular reliability problems.

Although a sheet inverter is referred to in the copier art as a "inverter", its function is not necessary to immediately turn the sheet over (i.e., exchange one face for the other). Its function is to effectively reverse the sheet orientation in its direction of motion. That is, to reverse the lead edge and trail edge orientation of the sheet. Typically in inverter devices, as disclosed here, the sheet is driven or fed by feed rollers or other suitable sheet driving mechanisms into a sheet reversing chute. By then reversing the motion of the sheet within the chute and feeding it back out from the chute, the desired reversal of the leading and trailing edges of the sheet in the sheet path is accomplished. Depending on the location and orientation of the inverter in a particular sheet path, this may, or may not, also accomplish the inversion (turning over) of the sheet. In some applications, for example, where the "inverter" is located at the corner of a 90° to 180° inherent bend in the copy sheet path, the inverter may be used to actually prevent inverting of a sheet at that point, i.e., to maintain the same side of the sheet face-up before and after this bend in the sheet path. On the other hand, if the entering and departing path of the sheet, to and from the inverter, is in substantially the same plane, the sheet will be inverted by the inverter. Thus, inverters have numerous applications in the handling of either original documents or copy sheets to either maintain, or change, the sheet orientation.

Inverters are particularly useful in various systems of pre or post collation copying, for inverting the original documents, or for maintaining proper collation of the sheets. The facial orientation of the copy sheet determines whether it may be stacked in forward or reversed serial order to maintain collation. Generally, the inverter is associated with a by-pass sheet path and gate so that a sheet may selectively by-pass the inverter, to provide a choice of inversion or non-inversion. The present invention may be utilized, for example, as an additional feature in the curved chute inverter of a recirculating document handler of the type disclosed in U.S. Patent application Ser. No. 57,855, filed July 16, 1979, by the same assignee in the name of Richard E. Smith and John R. Yonovich.

Typically in a reversing chute type inverter, the sheet is fed in and then wholly or partially released from a positive feeding grip or nip into the inverter chute, and then reacquired by a different feeding nip to exit the inverter chute. Such a temporary loss of positive gripping of the sheet by any feed mechanism during the inversion increases the reliability problems of such inverters.

The present invention is directed to improving the reliability of the inverter in this and other critical aspects of its operation, yet to also accommodate a range of different sheet sizes within the same size inverter and with the same mechanism. The present invention provides these improvements with an extremely low cost and simple inverter apparatus having a uniquely constructed and positioned sheet buckle responsive mechanism. The present invention does not require any additional drives, feed rollers, solenoids, sensors, or the like.

An early example of a sheet inverter with a curved baffle and a spring at the end of the inverting chute to accommodate variable sheet lengths is disclosed in U.S. Pat. No. 2,901,246, issued Aug. 25, 1959, to W. W. Wagner. Another sheet inverter, for a duplex document feeder, in which the inverter chute is curved, and of variable length, (due to a spring or gravity-loaded movable end of the chute) is disclosed in IBM Technical Disclosure Bulletin, Vol. 19, No. 12, May 1977, page 4496. A similar inverter structure is the "IBM Series III" copier in the copy sheet output path. Also noted in this connection is U.S. Pat. No. 3,337,213 issued Aug. 22, 1967, to L. J. LaBarre.

Other document sheet inverters with curved chutes are disclosed in U.S. Pat. No. 4,140,387 issued Feb. 20, 1979, to G. B. Gustafson and U.S. Pat. No. 4,158,500 issued June 19, 1979, to A. B. DiFrancesco.

Another type of sheet inverter, which utilizes gravitational force, i.e., the weight of the sheet, to assist the feeding out of the sheet from a generally vertical, open ended, inverter chute, accommodating different sheet sizes, is exemplified by the disclosures of U.S. Pat. No. 3,523,687 issued Aug. 11, 1970, to K. H. Peterson, et al., and a Ricoh Co., Ltd. Japanese application laid open Oct. 16, 1978, as Laid Open No. 53-118138. Inverters wherein the sheet is ejected from a reversing chute pneumatically are disclosed, for example, in U.S. Pat. No. 4,054,258, issued Oct. 18, 1977, and U.S. Pat. No. 4,159,824, issued July 3, 1979, both to K. K. Stange, et al..

The use of a resilient member, e.g., foam pads, at the end of a curved inverter chute to also assist the change in direction of motion of the sheet therein is disclosed in U.S. Pat. No. 3,856,295, issued Dec. 24, 1974, to John H. Looney. This patent also discloses feed-out rollers intermediately in the inverting chute for more positive sheet ejection.

It will be appreciated that the above-cited inverter disclosures are merely exemplary of numerous others in this highly developed field of art. The patents cited herein for art purposes are also hereby referenced to the extent that they provide teachings of usable or alternative apparatus for the disclosed embodiment herein. It will also be appreciated that the present invention may be incorporated into various xerographic or other copy sheet or document sheet handling apparatus, as additionally disclosed in these and other references.

As noted above, many inverters, particularly those utilizing only gravity, have reliability problems in the positive output or return of the sheet at a consistent time after the sheet is released in the inverter chute. Those inverters which use intermediate chute drive rollers or other drive mechanisms have a more positive return movement of the sheet, but besides requiring an additional drive mechanism in the chute, this normally requires a movement actuator (clutch or solenoid) for the drive and either a sensor or a timing mechanism to determine the proper time to initiate the actuation of this drive mechanism so that it does not interfere with the input movement of the sheet, and only thereafter acts on the sheet to return it to the exit nip or other feed-out means. Furthermore, inverter reliability problems are aggravated by variations in the condition or size of the sheet. For example, a pre-set curl in the sheet can cause the sheet to assume an undesirable configuration within the chute when it is released therein, and interfere with feed-out. Even the use of a curved chute, i.e., curved sheet guides or baffles to define the reversing chamber for the sheet, will not necessarily insure the proper orientation of the trail edge of the sheet relative to the exit nip unless the sheet is positively and consistently buckled within the chute. It is known that this buckling can be accomplished with a closed end chute, i.e., a fixed position sheet stop at the far or downstream end of the chute. However, this creates another serious problem in accepting or handling variations in the buckling of sheets which have different dimensions in the direction of the feeding of the sheet into the chute. It is known that a curved inverter chute may be equipped with spring-loaded or otherwise repositionable end stop to accommodate different lengths of sheets in the chute. However, such a variable length chute can create additional difficulties, besides requiring a longer, and usually open-ended, chute. Different weights or thicknesses of paper will have different beam strengths. If, for example, the spring force of a movable end stop of a chute is sufficiently light to be repositionable by a long, but thin, (low beam strength) sheet, it may be too weak to provide a sufficient positive return force for a heavier (stiffer) sheet, particularly where the beam strength of the sheet causes it to press harder, and therefor, have higher friction, against the walls of the curved chute. I.e. the self-straightening force of a stiff sheet can cause its ends to press against the concave side of the chute. This difficulty with variable chute length inverters can be reduced by making the chute more linear, i.e., less arcuate. However, this may not be desirable. There are many applications for inverters, such as in over-the-platen document handlers, in which a compact sheet inverter, with a highly arcuate chute, is highly desirable.

In contrast, the inverter disclosed herein can provide positive buckling of the sheet between a fixed end stop of a curved chute engaging the lead edge of the sheet and an input feeder which is pushing the trail edge of the sheet into the chute, for a positive sheet ejection force. Yet a conventional range of sheet dimensions, and a wide range of sheet thicknesses and weights, may be accommodated in this fixed length inverter chute, without sacrificing reliability of output feeding from the inverter chute. The inverter disclosed herein allows a highly arcuate and therefor more compact inverter configuration.

A preferred feature of the present invention is to provide in a sheet inverter mechanism with sheet feed means for feeding a sheet into and out of a first end of a curved sheet reversing chute, to reverse the lead and trail edge orientation of the sheet, the improvement comprising spring means positioned intermediately of said curved sheet receiving chute for intermediately springedly engaging a sheet in said chute for urging said sheet out of said chute.

A further preferred feature is to provide, in a method of reversing the direction of sheets of variable dimensions by feeding them into one end of a curved sheet reversing chute and feeding them out of the same end of said curved chute so that the lead edge and trail edge orientation of the sheets is reversed, the improvement comprising driving the lead edge of the sheets against a fixed lead edge stop in said chute irrespective of the dimensions of the sheets so that the sheet is variably buckled within said chute with a buckle height varying with the dimensions of the sheet, and intermediately applying a light spring force to the buckle in the sheet in the chute, said spring force being sufficiently low to allow unobstructed buckling of the sheet within the chute, and said spring force being sufficiently high to positively urge the trail end of the sheet being buckled in the chute back out from said chute.

Figure 2:
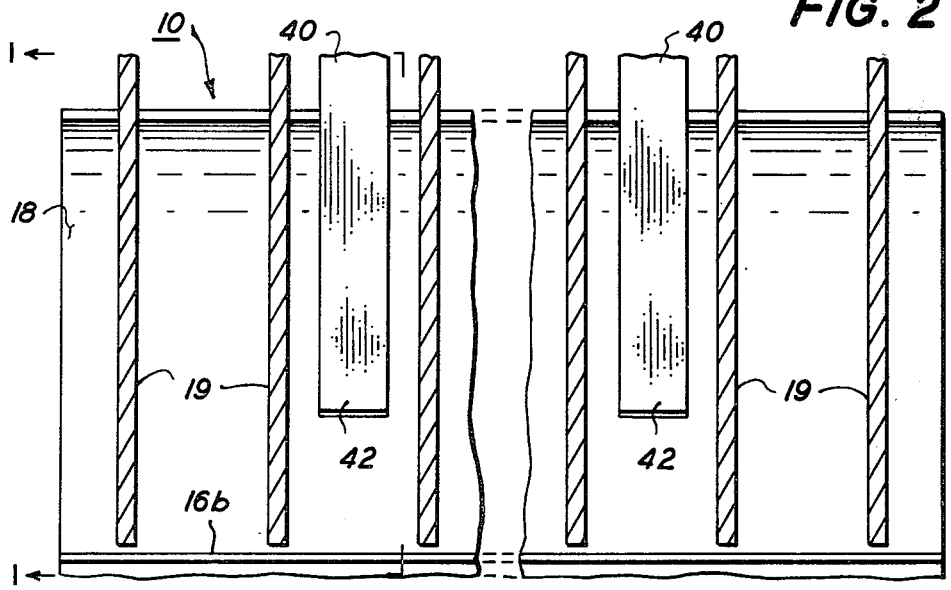

Further features and advantages of the invention pertain to the particular apparatus and steps whereby the above noted aspects of the invention are attained. Accordingly, the invention will be better understood by reference to the following description, and to the drawings forming a part thereof, which are approximately to scale, wherein:

FIG. 1 is a cross-sectional side view (viewed along the line 1—1 of FIG. 2) of an exemplary sheet inverter system in accordance with the present invention; and FIG. 2 is a cross-sectional end view of the apparatus of FIG. 1 viewed along the line 2—2 of FIG. 1.

FIGS. 1 and 2 illustrate one example of the present invention. However, it will be appreciated that the invention may have other embodiments. It will also be appreciated that the invention may be utilized in many different orientations or positions, and utilized in cooperation with various other sheet handling apparatus.

Referring first to FIG. 1, there is disclosed the exemplary sheet inverter 10 and a removable cover 12 integral therewith. The inverter 10 includes a semi-circular inverter chute 14 defined by an upper or outer wall 16 and a lower or inner wall 18. The outer wall 16 is in two parts; an upper portion **16*a* which is integral with the removable cover 12, and a lower portion 16*b* which is integral with the inner wall 18. In this manner, when the removable cover 12 is lifted, substantially the entire chute 14 is exposed for job recovery, i.e., removal of a sheet from within the chute 14**.

It will be appreciated that the chute 14 may be defined by various suitable sheet guiding surfaces such as baffles, wire guides, or the like, and need not be a continuous surface. For example, as further illustrated here in FIG. 2, the upper wall portion **16*a* is actually the curved inner surface of a plurality of ribs 19 projecting from the inside of the removable cover 12. They may be formed by integrally casting them with the cover 12. Although these ribs 19 may be widely spaced apart, the beam strength of the sheet, particularly as assisted by its arcuate deformation within the chute 14, renders the ribs 19 sufficient to conform the maximum excursion of the sheet to within the chute 14. Note that the chute 14 is quite wide or open, particularly at its first or input/output end 20. It tapers down here toward its opposite, fixed, end 22**.

This fixed position end 22 here is defined by a plurality of small foam pads 24 adapted to resiliently engage the leading edge of the sheet as it is driven all of the way into chute 14. Such foam pads 24 are not required, but serve to protect the lead edge of the sheet from damage and to provide noise reduction.

In the exemplary sheet inverter 10 here, the feeding means for feeding the sheet into and out of the first end 20 of the chute 14 is a conventional commonly and unidirectionally driven three roller axes system. A plurality of rollers 26, 27, and 28, are respectively mounted along these three axies in continuous rolling engagement with one another. This provides a sheet drive input nip 30 between the rollers 27 and 28, and a sheet output feeding nip 32 between the rollers 27 and 26. As indicated above, a diverter gate and path (not shown) may be provided to bypass the entire sheet inverter 10, if desired.

In order to reverse the lead and trail edge orientation of a sheet, the sheet is driven into the chute 14 through the input nip 30 until the lead edge of the sheet strikes the foam pads 24 providing a fixed stop for this lead edge. Continued driving in of the sheet by the nip 30 buckles the sheet within the chute 14 in a buckling direction controlled by the configuration of the chute walls. This buckling curvature of the sheet causes, due to the inherent resiliency or beam strength of the sheet, a tendency of the sheet to self-straighten. Thus, after the trail edge of the sheet has been fed into the chute 14, i.e., released by the nip 30, the now free trail end of the sheet tends to move upwardly here away from the nip 30 toward the upper chute wall 16. The upper chute wall 16 at the chute end 20 is positioned adjacent the output nip 32, so the sheet trail edge is guided into the output nip.

This movement of the trail edge of the sheet between the input and output nips is assisted by the upward movement of the surface 34 of the roller 27 within the chute facing the trail edge of the sheet. Thus, when the trail edge of the sheet can be pressed with a controlled buckling pressure against this surface 34, a more positive and controlled movement of the trail edge of the sheet toward and into the output nip 32 can be provided. The dashed line 36 here is shown to represent the position of a sheet being so moved within the chute 14 between the input and output nips 30 and 32.

It will be appreciated that sheets which have a different dimension in their feeding direction must assume different buckle configurations within the chute 14, because there is desirably a fixed or given length of the chute 14 between its input/output end 20 and its fixed end 22. The distance between the upper and lower walls 16 and 18 of the chute may be made sufficiently great to accommodate such differences in the height and radius of the buckle position of the sheet. However, it has been found that these different sheet dimensions create reliability problems, and this problem is aggravated by sheets of different thicknesses, which have different beam strengths. For example, a large and stiff (thick) sheet will have a high buckling force, and therefore a high force on the trail edge of the sheet tending to lift and push the trail edge of the sheet out toward the exit nip 32. In contrast, a shorter and/or thinner sheet will have less of a buckle and also less self-straightening force and thus may not be as reliably captured by the output nip 32. That is, the sheet may become stuck in the inverter chute 14 with its trail edge slipping at the input nip 30 output on the surface 34, or may take a longer time to reach the nip 32.

It will be appreciated, however, that the sheet dimensional range which may be reliably handled with a sheet inverter 10 is not unlimited. Some buckling of all sheets in the chute 14 is desired. Thus, the length of the chute 14 along the inner wall 18 thereof is preferably shorter than any sheet to be reversed within the chute 14. Likewise, the maximum sheet dimension desirably fed into the inverter 10 is the circumferential length of the outer boundary 16 of the chute 14. These dimensions can be, of course, respectively decreased and increased from those illustrated here. I.e., a wider(more open) chute with a wider range of sheet dimension capabilities may be provided. However, it has been found that if the sheets are fed into and out of the inverter by their short dimension, i.e., with their longest dimension transverse the inverter chute 14, (known as long-edge-first feeding) that the inverter 10 need only be designed in the U.S. to accommodate sheets of a feeding direction length (sheet width) of between 8 inches (20.3 centimeters) and 8.5 inches (21.6 centimeters). This is because the most common standard paper sheet sizes are generally as disclosed in the following table:

Common Standard Commercial Paper Sheet Sizes

| Size Description | Size in Inches | Size in Centimeters |
|---|---|---|
| 1. Government (old) | 8 × 10.5 | 20.3 × 26.7 |
| 2. U.S. Letter | 8.5 × 11 | 21.6 × 27.9 |
| 3. U.S. Legal | 8.5 × 13 | 21.6 × 33.0 |
| 4. U.S. Legal | 8.5 × 14 | 21.6 × 35.6 |
| 5. U.S. Engineering | 9 × 12 | 22.9 × 30.5 |
| 6. ISO* B5 | 6.93 × 9.84 | 17.6 × 25.0 |
| 7. ISO* A4 | 8.27 × 11.69 | 21.0 × 29.7 |
| 8. ISO* B4 | 9.84 × 13.9 | 25.0 × 35.3 |
| 9. Japanese B5 | 7.17 × 10.12 | 18.2 × 25.7 |
| 10. Japanese B4 | 10.12 × 14.33 | 25.7 × 36.4 |

*International Standards Organization

Not only are the most common U.S. sheet sizes accommodated within this range of inverter capabilities of between 20.3 and 21.6 centimeters, but also the 21 cm. dimension of International Standards Organization A4, which is widely used outside of the U.S.. By extending the lower range of capability to 17.6 centimeters, ISO B5 and Japanese B5 sheets may additionally be handled within the same fixed size inverter chute.

The above described variations in sheet dimensions and stiffnesses, and their associated problems, are substantially alleviated here by spring members 40 positioned intermediately of the curved sheet receiving chute 14 for intermediately springedly engaging a sheet in the chute 14 so as to urge the sheet back out of the chute into the exit nip 32. The arcuate curvature of the chute 14 and the position of the spring members 40 causes the sheets to buckle against the spring members 40 within the chute 14. The spring members 40 are configured and designed so as to be easily deformable by the sheets as they are being buckled within the chute 14. They freely allow the variable buckling of sheets of variable dimensions. Yet, although the spring members 40 allow virtually unrestricted buckling, they provide a controlled and variable sheet buckling force acting differently against sheets of different dimensions, i.e., sheets having different buckle heights.

The solid line position of the spring member 40 in FIG. 1 shows its unsprung or initial condition. The illustrated dashed line position is one such deformed position, as deformed by the exemplary illustrated buckled sheet 36. However, this position will vary to conform to whatever maximum buckle height the particular sheet has, regardless of the sheet dimensions. It also deforms to follow, and centrally continuously abut, the sheet as its buckle expands and contracts, i.e., from the time the trail edge of the sheet is being fed into the nip 30 until it begins to feed out of the nip 32.

The exemplary spring members 40 here are at least two thin sheet spring members cantilever mounted outside of the chute 14 and extending therethrough to chordally intersect the chute and thereby intersect the movement path of the sheet into the chute 14. As shown, the unsprung position of the member 40 may be resting against the inner surface 18 of the chute, or even be slightly pre-sprung thereagainst.

It may be seen that the spring members are mounted so that a completely unsupported and highly deformable extending portion thereof will lightly but continuously springedly engage (press against) a sheet being buckled in the chute 14. Preferably this is the only resistance to the buckling of the sheet other than its own beam strength. It may be seen that the members 40 here are cantilever mounted to the cover 12 by any suitable means, such as double faced adhesive tape, at one end thereof. The remainder of each member 40 is unsupported and freely movable in the space between the ribs 19, i.e., extendable in and out of the chute 14. Thus, the member 40 extends through the outer or upper wall 18 defining the chute 14.

If desired the otherwise free end 42 of the spring members 40 may be so dimensioned and positioned that when it is highly deflected it may engage a fixed surface, such as the inside of the cover 12. This is illustrated by its dashed line position here. This provides an additional support for the spring members 40, increasing their flexural resistance for greater deformations once this deflection position is reached. This allows for an additional control factor, i.e., a stepped increase in the spring strength of the still unsupported intermediate portion of the member 40. However, this feature need not be provided unless desired, i.e., the spring end 42 may be allowed to remain free and unsupported regardless of the extent of deflection of the member 40. In either case the free end 42 is preferably deformable out of the chute, through the outer wall 18.

As an example of a suitable spring member 40, particular springs which have been found to be suitable are approximately 1.27 centimeters wide and 0.16 millimeter (0.005 inches) thick beryllium/copper commercial leaf spring sheet material. The members 40 may be spaced across the width of the sheet, i.e., transverse its direction of feeding they extend in their elongate dimension generally in the direction of movement of the sheet with the supported end thereof upstream of their free end, i.e., closer to the input/output end 20 of the chute 14. This provides a very soft or light spring force, which is adapted to move with and accommodate the sheet buckle of even a quite thin sheet, rather than to flatten such a sheet against the chute wall 18 thereunder as would be the case with a conventional spring. It will be appreciated that the spring member 40 could be replaced by an appropriate gravational force member providing a correspondingly light force to the buckling sheet's outer surface at the corresponding location.

The long and generally linear path of the spring member 40 intersecting through the chute 14 allows a wide range and wide variation in the position of contact between the buckling sheet and the spring member 40. This is highly desirable, since the peak or apex position of the sheet may vary considerably during the movement of the sheet in and out of the chute. Thus, as the buckle changes and the spring member 40 flexes therewith, the spring member 40 may remain tangential to the apex of the sheet buckle, centrally of the sheet. Note that if the spring member 40 acted against the sheet near either its leading or trailing edges instead of centrally that this would tend to deform the sheet buckle configuration within the chute away from those points without necessarily increasing both the normal force of the trail edge of the sheet against the roller surface 34, and the normal force of the lead edge against the foam pad 24, as desired.

It will be appreciated that although two independent spring members 40 are illustrated, that a different number of springs, or even a single, and wider, central spring, may be utilized instead, providing the appropriately light and controlled forces described herein are provided.

To summarize the above disclosed sheet reversing method, it may be seen that with the sheet inverter 10, the direction of movement of sheets of variable dimensions may be reliably reversed by feeding them into one end 20 of the curved sheet reversing chute 14 and then feeding them out of that same end 20 of the chute 14 so that the lead and trail edge orientation of the sheet is reversed. As disclosed herein, this may be accomplished by driving the lead edge of the sheets against a fixed lead edge stop 22 in the chute 14 irrespective of the dimensions of the sheets so that the sheet is variably buckled within the chute 14 with a buckle height which varies with the dimension of the sheet in its feeding direction, and by applying to an intermediate portion of the sheet buckle a light force which is sufficiently low to allow unobstructed buckling of the sheet within the chute but sufficiently high to positively urge the trail end of the sheet from the chute. As disclosed herein this light force is preferably provided by buckling the sheet against an unsupported intermediate portion of a thin elongated spring member which extends unsupportedly chordally through the chute intermediately thereof.

While the inverter apparatus and method disclosed herein is preferred, it will be appreciated that various variations, alternatives or improvements therein may be made by those skilled in the art, and the following claims are intended to encompass those falling within the true spirit and scope of the invention.

What is claimed is:

1. In a sheet inverter mechanism with sheet feed means for feeding a sheet into and out of a first end of a curved sheet reversing chute, to reverse the lead and trail edge orientation of the sheet, the improvement comprising:

spring means positioned intermediately of said curved sheet receiving chute for intermediately springedly engaging a sheet in said chute for urging said sheet out of said chute wherein said spring means comprises at least one elongated and highly deformable spring member; said spring member in its unsprung condition, chordally intersecting said chute to intersect the movement path of a sheet in said chute; said spring member being mounted so that an unsupported and highly deformable portion thereof will lightly springedly engage a sheet buckled in said chute, and wherein said chute is sufficiently wide and said spring members are sufficiently deformable to allow different length sheets to buckle with different buckle heights within the chute unobstructedly except only for said light engagement of the sheet buckle with said spring members.

2. The sheet inverter mechanism of claim 1, wherein said chute terminates in a fixed position closed end, and said chute has a fixed length between said first end and said closed end which is shorter than a sheet to be reversed therein, and wherein a sheet is driven into said chute and buckled therein against said closed end by said feed means, and wherein said spring means provides a variable sheet buckling control force against sheets of variable dimensions variably buckled in said chute, and wherein said spring means is easily deformable by said sheets to allow said variable buckling of sheets of variable dimensions.

3. The sheet inverter mechanism of claim 1, wherein said chute is generally semi-circular in configuration.

4. The sheet inverter mechanism of claim 1, wherein said chute is arcuately curved towards said spring means to buckle sheets therein against said spring means.

5. The sheet inverter mechanism of claim 1, wherein said sheet feed means drives a sheet into said chute through a first sheet feeding roller nip and out of said chute by a second sheet feeding roller nip, and wherein said chute is configured relative to said first and second nips and said spring means so that said spring means tangentially centrally engages and urges a sheet buckled in said chute into said second nip.

6. The sheet inverter mechanism of claim 1, wherein said spring member is cantilever mounted from only one end thereof to extend unsupportedly through said chute, said one mounting end of said spring member being mounted outside of said chute.

7. The sheet inverter mechanism of claim 6, wherein said curved chute comprises outer and inner opposing and spaced apart guide members defining outer and inner wall of said chute, and wherein said spring member is mounted from said one end thereof to extend through said outer wall of said chute and extend toward said inner wall of said chute in its unsprung condition, and wherein the unmounted end of said spring member is deformable through said outer wall of said chute by a sheet buckled in said chute.

* * * * *